United States Patent [19]

Kröling

[11] Patent Number: 4,472,082

[45] Date of Patent: Sep. 18, 1984

[54] DIVING DEVICE

[76] Inventor: Peter Kröling,
Joseph-Gerstnerstrasse 3, D-8033
Martinsried, Fed. Rep. of Germany

[21] Appl. No.: 380,721

[22] PCT Filed: Sep. 16, 1981

[86] PCT No.: PCT/DE81/00143

§ 371 Date: May 10, 1982

§ 102(e) Date: May 10, 1982

[87] PCT Pub. No.: WO82/00985

PCT Pub. Date: Apr. 1, 1982

[30] Foreign Application Priority Data

Sep. 17, 1980 [DE] Fed. Rep. of Germany ..... 3035129

[51] Int. Cl.[3] ..... B63C 11/20

[52] U.S. Cl. ..... 405/186; 128/205.18; 417/234

[58] Field of Search ..... 405/185, 186; 417/61, 417/234; 128/201.27, 201.28, 201.11, 205.18

[56] References Cited

U.S. PATENT DOCUMENTS

| | | | |
|---|---|---|---|
| 183,521 | 10/1876 | Weck | 405/186 X |
| 1,197,115 | 9/1916 | Fell et al. | 405/186 X |
| 2,138,845 | 12/1938 | Erickson | 128/205.18 |
| 2,593,988 | 4/1952 | Cousteau | 128/201.27 |
| 2,906,263 | 9/1959 | Wolshin | 128/205.18 |
| 3,050,055 | 8/1962 | Vautin | 417/234 |
| 3,124,131 | 3/1964 | Gross | 417/234 X |
| 3,461,866 | 8/1969 | Ritchie | 128/205.18 |
| 3,467,091 | 9/1969 | Aragona | 128/201.11 |
| 4,022,201 | 5/1977 | Diggs | 128/201.27 X |
| 4,319,699 | 3/1982 | Willers et al. | 417/234 X |

*Primary Examiner*—Dennis L. Taylor
*Attorney, Agent, or Firm*—Collard, Roe & Galgano

[57] ABSTRACT

Air supply to divers from the water surface. In a diving device for divings in shallow water, comprising a supply element (59) having a tubular shape with an air inlet opening and an air outlet opening for supplying air from the water surface to at least one diver's mouthpiece, there is arranged a pump (33) in the supply circuit to provide permanently a predetermined amount of air independently of the diving depth, even under the physiological limit of the pipe of 0.35 m under the water level. There is provided a device (63, 15, 87, 17) to actuate mechanically the pump (33) directly or indirectly by the diver.

6 Claims, 4 Drawing Figures

DIVING DEVICE

DESCRIPTION

Figure 1:
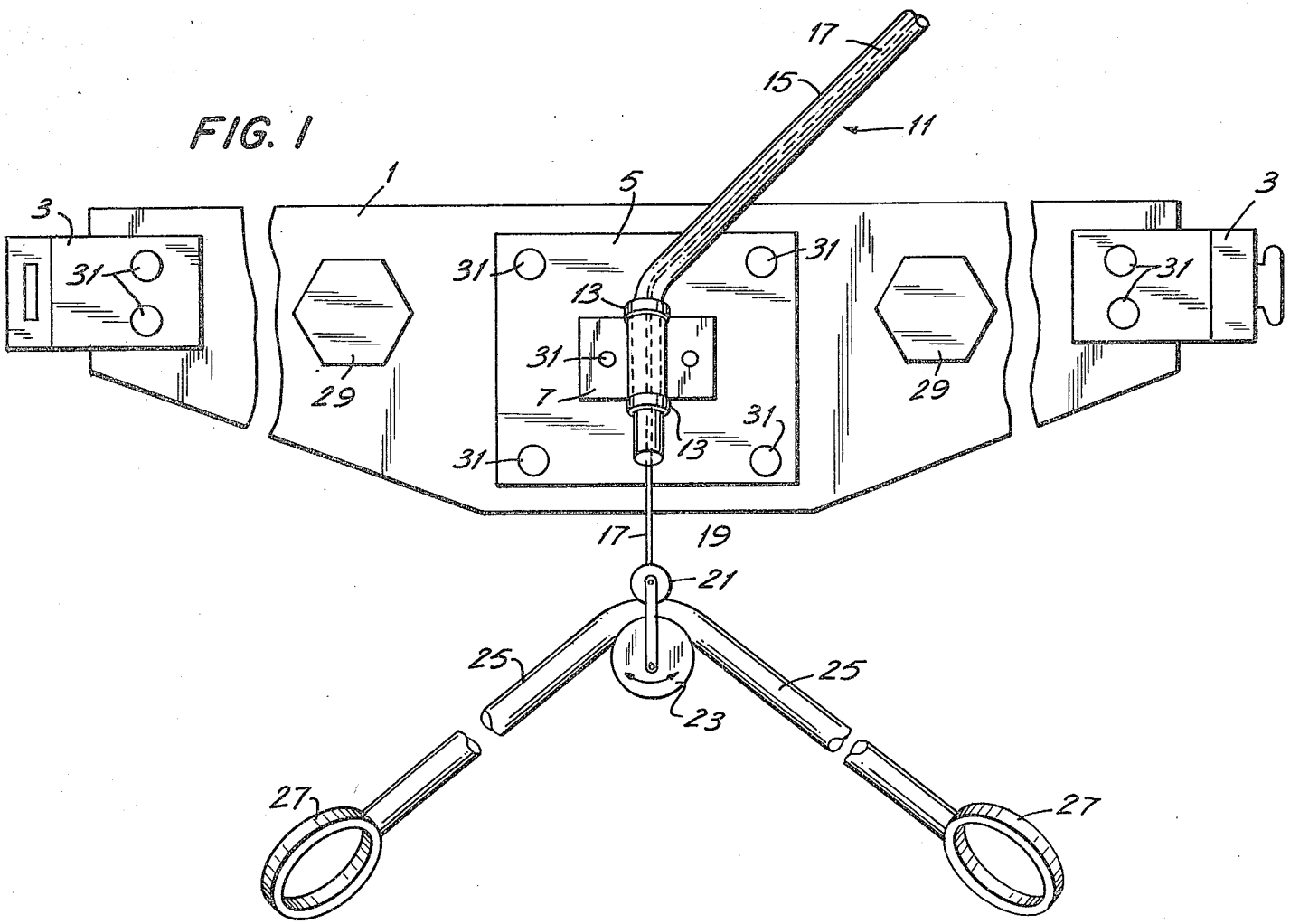

The invention relates to a diving device for diving in shallow water, with a tube shaped supply element with an air inlet and an air outlet opening for supplying air from above the water surface to at least one diver's mouthpiece.

Such devices are known as air intakes. The tube like supply element is mostly rigid in the known devices, for example, a plastic tube. For example, it should be understood to also mean a flexible hose. During use, the air inlet opening is disposed above the water surface and the air outlet opening which is formed in a mouthpiece or provided therewith is disposed in the mouth of the diver, for example. However, air intakes have the disadvantage that the diver can remain constantly below the water surface at a depth equal to the length of the air intake (conventionally 0.35 m), while at deeper diving depths he must return, at least at the end of his personal breath holding time capacity, to at least the height of 0.35 m below the water surface for taking in of air, like any other diver without any auxilliary means.

Thereby, with an air intake the continous close observation of a process or a structure at depths of 1 to 2 m, which is a particularly interesting range for a diver, is not possible.

It was already suggested to merely extend the air intake for a constant obtaining of deeper diving depth. However, for physiological reasons such an air intake is not useable. When the lung is connected directly with the air above the water surface, that is, the atmosphere, by means of the air intake inlet opening an inner pressure prevails at the air outlet opening and thereby in the lung which is equal to the air pressure on the water surface, i.e., of about ($1.10^5$ Pa ($\approx$1 atm 1 Bar (b)$\approx$"10 m $H_2O$"), since the additional air column with respect to the additional water column is immaterial, while at the outside of the body and thereby also on the outside of the lung at a diving depth of, for example, 1 m, the atmospheric pressure plus the pressure of the additional water column of 1 m, that is about $1.1.10^5$ Pa ($\approx$1.1 atm$\approx$"11 m $H_2O$") prevails. Therefore, a pressure differential of about $0.1.10^5$ Pa exists. However, since already a positive pressure differential outer pressure ./. lung inner pressure of $0.06.10^5$ Pa ($\sim$0.06 b$\sim$0.6 m $H_2O$) causes permanent damage due to a lung edema, the use of air intakes longer than, for example, 0.6 m, represents a serious health hazard.

In addition, the lung can generate only a vacuum pressure which corresponds to about 0.5 m water column with active force, i.e., about $0.05.10^5$ Pa, so that an air intake by means of an air intake means in larger depth is made impossible anyhow.

For a longer stay below the water surface (i.e., for a considerably larger time period than the breath holding capacity of the diver) diving devices with compressed air bottles are known. Thereby, by means of an automatic control air is delivered from a compressed air bottle, for example, through a mouthpiece to the lungs corresponding to the given water pressure, so that the lungs are supplied with air, whereby the lung inside pressure is in the proximity of the outer pressure.

However, these diving devices require a considerable, expensive and in particular heavy and unwieldy equipment, due to the pressure bottles. Due to the deeper diving depth made possible and the dangers connected therewith, its use requires a specific training. Furthermore, the duration for diving is limited by the bottle content and if no compressed air station or a spare bottle is available, a renewed diving is not possible.

It is therefore an object of the invention to further improve a diving device of the mentioned type in such a manner that it is possible to obtain a permanent diving, i.e., in particular a diving independent from a limited air amount in shallow water depth, however also below the physiological air intake limit of 0.35 m water depth, free from outside assistance.

This object is solved in accordance with the invention in that an air pump is provided in the circuit of the supply element from the air intake opening to the air outlet opening on which actuating devices are provided for the direct or indirect mechanical actuation by the diver.

An air pump is to be understood as any device which feeds atmospheric air from its suction side to its pressure side under excess pressure and is held there, i.e., that an escape of air from the space into which it was fed, is prevented by the resistance of the pump. This can be, for example, a suitable shaped bellows. Therefore, the air pump feeds air by compression from the air inlet opening to the air outlet opening.

In the circuit of the supply element this means, that the pump is switched on in the tube like supply element (which, if need be, can be bisected), so that the intake side of the pump (suction pipe connection) faces the air intake opening and the pressure side of the pump (pressure pipe connection) faces the air outlet opening. In a borderline situation this means however, that the pump is connected to one end of the supply element, so that the pressure pipe connection can be connected to the air intake opening and the suction pipe connection can be connected to the air outlet opening.

The one upper part connected to the suction pipe connection of the pump of the bisected tube like supply element if need be, can be either shorter or longer with respect to the water surface, depending on the maximum permanent diving depth for the pump. Thereby, the maximum diving depth is that diving depth up to which one can dive by using the diving equipment without forcibly pulling the air suction opening of the pump or the air intake opening of the supply element below water.

The length of the other lower part which is mounted to the pressure pipe connection of the pump also depends from the position provided for the pump and also from the provided maximum permanent diving depth.

In the simplest case, the actuating devices may be, for example, handles or pedal like devices, or the like, for a direct actuation of the pump. However, they may be mounting devices and rods, cable ropes or similar power transmission devices mounted thereon which permit an indirect mechanical actuation of the pump by the diver. It is important that two engagement forces can be performed in order to move the actual pumping part, for example, the piston and the surrounding part, for example, the housing of the pump at least in one direction with respect toward each other.

The inventive solution in particular has the advantage that increased pressure is fed to the diver in a simple manner, i.e., in particular without outside driven machines or the assistance of third or complicated and heavy devices, like compressed air devices, air from the water surface, so as to correspond to the larger diving depths. Thereby, the required check valve which is present in any given shape in the pump that a direct connection exists between the lungs and the atmospheric air which is under a lower pressure. However, if need be a separate check valve may be provided.

Thereby, the actuating devices for the direct or indirect actuation permit a mechanical actuation by the diver himself. This actuation is preferably coordinated with the swimming movement, particularly preferred with the leg movements, by suitably shaping the means therefor. Therefore, the invention permits a stay below the water in larger depth than heretofore possible not being limited by the device. While during the air intake diving the diver must practically return to the water surface at least at the end of his personal breath holding time capacity and while the compressed air device, due to the limited filling of the gas bottle, causes the diving to be limited to a duration of about 30′ to 60′, one can dive to depth of 3 to 4 m as long as one wants with the device in accordance with the invention. The force required corresponds to a leisurely bicycle drive, as will be illustrated later.

Preferably, the pump is connected to the air intake opening and is provided with drive means for holding at least the air intake opening above the water surface up to the maximum permanent diving depth.

This has the particular advantage that the diver is connected directly only with the actuating devices and the supply element, i.e., namely with a hose, while the pump is held above water by means of its lifting means, at least its suction opening, so that it can suction air. In particular, this permits a freer movement possibility for the diver.

Preferably, the lifting means are inflatable. This has the advantage with respect to other lifting means, for example, styropore blocks, that during nonuse the lifting means hardly require any space and can have a practically light weight which further reduces the total weight of the device.

Preferably, a rotating part is provided driven by the pump movement particularly preferred in shape of a rotating disk with a horizontal rotating axis during operation which is provided with differently reflecting sectors. Due to the horizontal rotating axis during operation, that is, when the pump is in the water the disk is positioned vertical with respect to the water face, can also be very well seen by other observers. Thereby the presence of the diver can be seen, on the one hand, and the actuation of the pump can be determined by the diver, on the other hand. The suggested further embodiment performs a location and warning function.

In an alternative preferred embodiment, the pump is positioned in the lower range of the tube like supply element, i.e. in the proximity of the air outlet opening, and mounting devices are provided to be mounted on the diver, preferably on the back of the diver. This, in particular, has the advantage that the diving device can be designed more compact since only the connecting part and not the actuating devices must be guided to the water surface. Also, the lifting device, which is required and which is a preferably non-rigid connecting part, can be designed correspondingly smaller since it only has to support the weight of the connecting part. Furthermore, the actuating paths between diver and pump are correspondingly shorter, so that the actuating devices get lighter and have fewer friction losses, if need be. Due to the support or the holding of the housing on the body, only one part of the movement devices may be provided, namely for the reciprocating movement of the pump piston (=supply element).

Preferably, the pump is driveable in particular by a reciprocating movement. Thereby, the transmission of the actuating body movements of the diver to the pump can be considerably simplified and in particular the pump movement can be easier coordinated with the swim movements or it can completely coincide therewith.

The pump is preferably an intermittent operating pump, preferably a piston pump with reciprocating piston and a stroke volume which corresponds to a breathing volume at a light to medium body stress (1.5-3.1 l).

This is particularly advantageous in that the pump operates analogous with the intermittent operating breathing, so that its actuation can be easily adjusted to the natural breathing. Thereby, the feedable amount of breath which can be fed at a maximum by the pump corresponds to a strong breath, for example, to the reserve air (2-3 l) which the lungs can still absorb in addition to normal breathing, so that with one stroke an optimum usable air amount can be fed.

In a particularly preferable embodiment an accumulator is switched between the opposite moving pump parts of the pump, which is charged during the pump movement in a direction, preferably the pressure direction and drives the movement in the other direction, i.e. effects the return positioning of the piston, if need be.

This results in a particularly considerable simplification of the power transmission, since the actuating device can be simplified because it may consist of one part which reacts only to pull and one part which reacts only to push.

In a preferred embodiment of the invention, the accumulator is a spring, preferably a torsion spring, which is restrained between the upper area of the piston rod and the housing. Therefore, the piston has to be moved by an active actuation only into one direction toward the housing, while the counter movement is automatically performed during the reduction of the actuating force. Therefore, actuating means have to be provided which actuate the piston rod only in this one direction and thereby support the housing.

Preferably, the part of the actuating devices, which is defined for the force effect on the pumping part, is provided with a part which substantially reacts to pull and the part of the actuating device, which is defined for the other part of the actuating devices, is provided with a part which substantially reacts only to pressure. Such parts can be made constructively simpler than parts which respond to pull and pressure absorbing the full force. For example, parts which respond only to pull, like ropes, take considerably less space in packed condition.

Preferably, the actuating devices are provided with at least one Bowden pull. A Bowden pull is such a construction of parts which respond substantially only to pull or substantially only to pressure. Thereby, the particular advantage exists that both parts are flexible, but that the part (the sheath) which is loaded by pressure cannot bend sideways due to the pull loaded part (rope or cable) guided therein.

Preferably, the part which is defined for the force effect to the one pump of the actuating device supports on a belt, preferably a diving belt.

This has the particular advantage that the force effect must be carried out actively only to one of the opposite moveable pump parts, for example, by arm or leg movements, while the required counter force of the other part in the relative opposite direction is absorbed or performed by the belt and finally by the body portion on which the belt is mounted. Instead of a belt which is mounted around the waist of the diver, in the narrow sense of the word, other devices which are mountable on the body may be used, like shoulder belts. Preferably, the part of the actuating device which is stressed by pressure is the longitudinally incompressible sheath of a Bowden pull and the part of the rope or cable of this Bowden pull which is stressed by pull.

This in particular makes it possible to overcome the longest part of the distance to be overcome between the diver or the engagement means actuated by him and the pump, or the mounting means mounted thereon, only by means of a Bowden pull.

Preferably, the one lower jacket of the Bowden pull is mounted on the belt. In this manner, the jacket can transmit the pressure of the sheath to the belt.

Preferably, the longitudinal axis of the lower jacket extends transverse to the length of the belt and parallel to the belt plane in the mounting area. Thereby, the particular advantage is obtained in that the force is effective in transverse direction of the belt, whereby it is particularly well absorbed by the body.

Preferably, the lower jacket is deflected in their upper areas facing the jacket. This has the particular advantage that in this manner the Bowden pull is moved away from the belt and body plane and thereby from the body itself, on the one hand, and that the pressure of the sheath imparts onto the jacket a force component vertical with respect to the belt plane and thereby directly onto the body, whereby a lesser force displaces the belt downward, i.e., in the direction of the legs. However, this presumes that the belt is "correctly" attached, i.e., with the jacket directed upwardly (head direction) and the jacket opening for the wire (downwardly), i.e., in the leg direction.

Preferably, the lower jacket of the Bowden pull is rotatably mounted. Thereby, a freer moveability of the diver is obtained.

Preferably, the end of the wire which extends from the lower jacket of the Bowden pull is connected with a rope.

While a wire is preferred in the Bowden pull, because it requires a minimum of space and has a minimum of friction, the use of a rope, in particular a soft plastic rope has the advantage that no injuries can occur during actuation.

Preferably, the rope is guided over the roller of a roller shackle which is mounted at the end of the wire. Thereby, a pull can be performed at both ends of the rope and thereby also at a changeable length (however, at constant sums of the length) from the end of the wire to the body parts to be actuated. Therefore, the actuating legs could be at a different angle, for example.

In a particularly preferred embodiment, the rope is provided at least at its one end with a device for mounting at the lower area of the leg of the driver, preferably a foot loop.

This measure in particular has the advantage that at a suitable dimensioning of the length of the rope for pulling the wire from the Bowden pull out of the jacket, so that the pump is actuable corresponding to the leg movement during swimming. The connection between the active body part and the wire is naturally not limited to a rope, but the wire can be correspondingly extended. However, a rope, in particular a soft one is preferred.

Preferably, the sheath of the Bowden pull is connected with the housing and the wire of the Bowden pull is connected with the moveable pumping part within the housing. Thereby, during an actuation of the Bowden pull, the piston is moved in the pump, while the pump housing is supported by means of the sheath and the other end of the sheath is supported by a rigid part relative to the diver, for example, the sacrum, so that the sheath remains stationary.

Preferably, the other upper jacket of the Bowden pull extends through the bottom of a cylindrical housing of the pump into the pressure chamber and the wire is connected with a part of the piston guided within the cylinder facing the pressure chamber. This design has the particular advantage that the wire and the sheath can be guided particularly simply, in particular it does not have to be deflected or guided around the outside of the pump.

Preferably, the upper jacket of the Bowden pull is extended almost to the upper closure of the pump housing and a bore is provided in the piston for the jacket, whereby the bore is extended by a pipe parallel to the movement direction of the piston which is closeable above by the valve which connects the pressure cylinder with the outside air and that the wire of the Bowden pull is mounted on a retaining part positioned in the upper part of the pipe and the upper closure is provided with an opening permitting the extension of the pipe therethrough. This in particular is advantageous in that the Bowden pull is not completely sealed against penetrating water but that the pump can be immersed deeper than usual into the water, since the outlet of the Bowden pull can be positioned high with respect to the pump chamber without impairing the simple attaching of the Bowden pull. Thereby, the pipe acts simultaneously like a piston rod pushing on the piston from above to below.

Preferably, an excess pressure valve is provided in the proximity of the air, outlet opening which is preferably provided with a mouth piece of the tube element connecting part. This in particular has the advantage that no additional air can be pumped into an already completely filled lung, but that it escapes through the excessive pressure valve. In addition the excess pressure valve permits the breathing out and also through the breathing opening through which the breathing occurs.

Preferably, the excess pressure valve is provided with a spring which opens the valve at an excess pressure in the tube like connecting piece at 0.2-3 preferably at 0.5 KPA. This is an excess pressure at which the lung is not damaged yet, on the one hand, and which permits the breathing out, on the other hand.

In the following, the invention will be explained in more detail in conjunction with preferred embodiments with respect to the attached drawings which are particularly referred to due to the extensive clearness and distinctiveness. The drawing shows.

Figure 2:
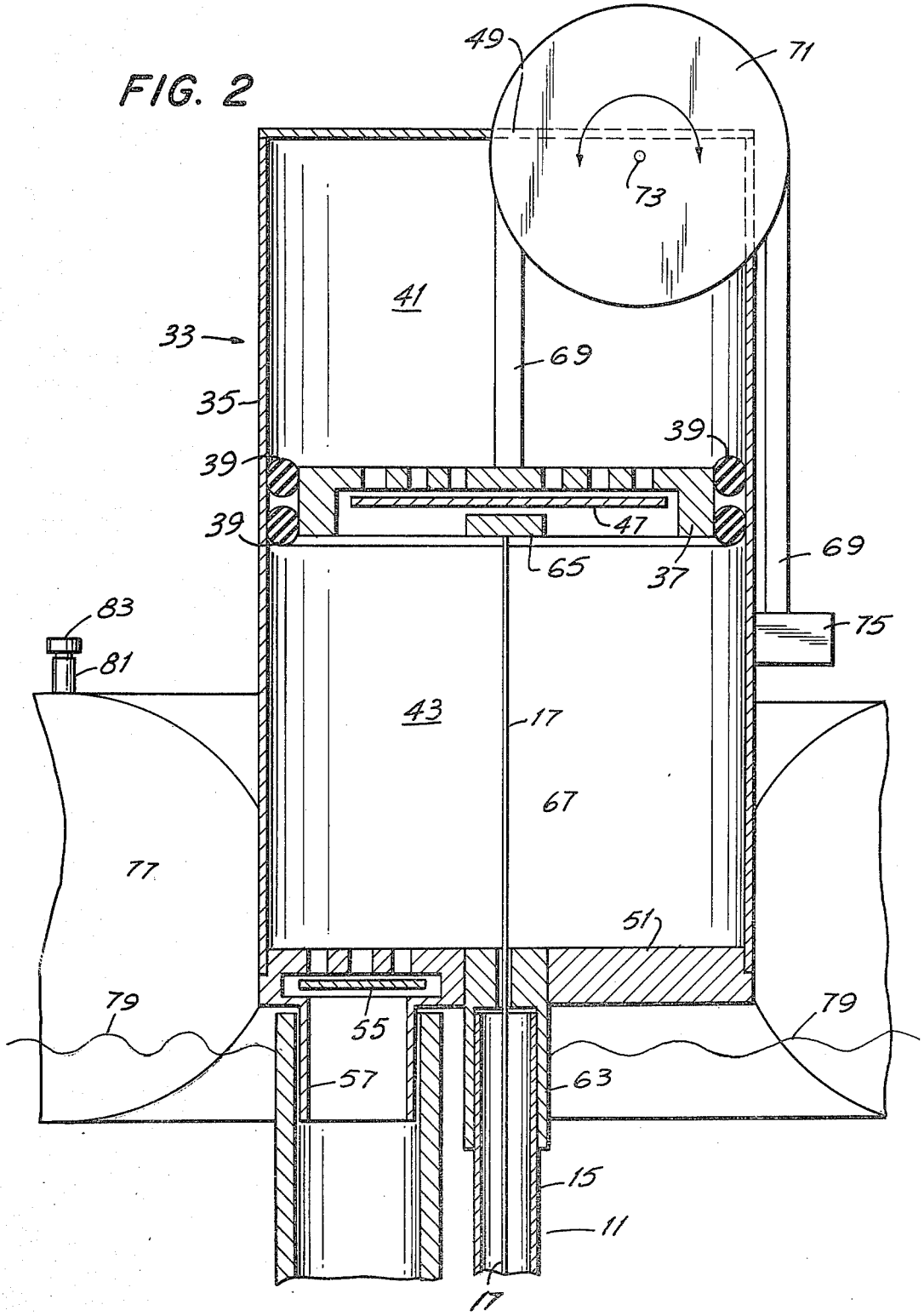
Figure 3:
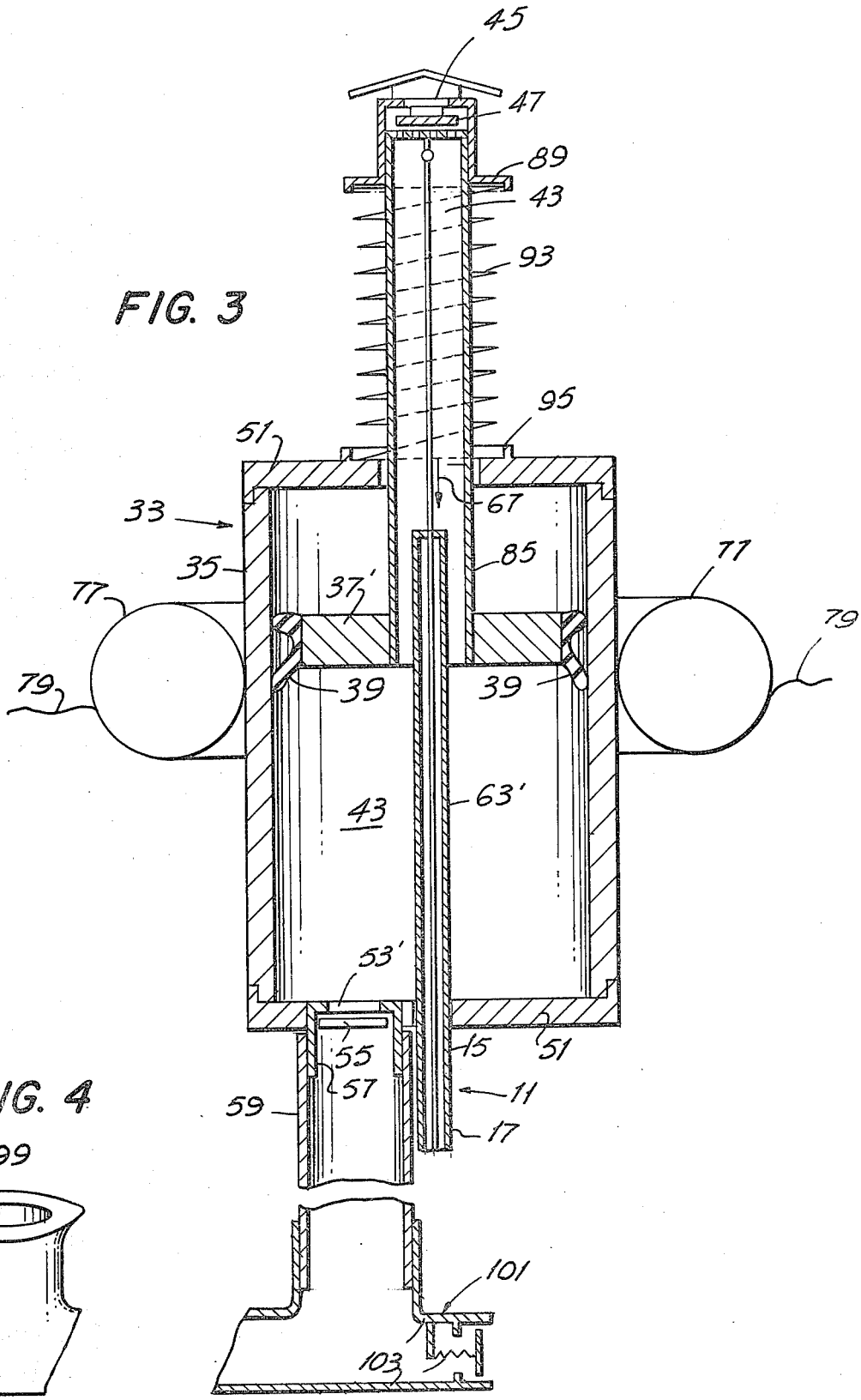
Figure 4:
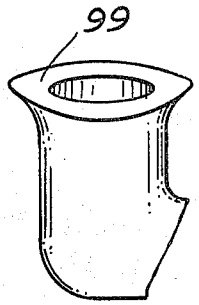

FIG. 1 a view of the preferred embodiment of elements of the actuating device for an indirect mechanical actuation of the pump in form of a belt with the Bowden pull attached thereto;

FIG. 2 a section through a preferred embodiment of an air pump in accordance with the invention;

FIG. 3 a section through a further embodiment of an air pump in accordance with the invention, and FIG. 4 a partially sectional and schematized view of the mouth piece in accordance with the invention.

FIG. 1 shows a belt 1 made of a tough plastic, for example PVC. The belt is preferably adjustable in its length (not shown). At the ends thereof a rapid locking device 3 is mounted which is usually employed with diving belts, for example, riveted (31). At the one side of the belt, that is, during wearing on the outer side of the belt a pressure plate 5 is securely fastened on the center of its longitudinal extension, preferably riveted thereon. Preferably this plate 5 is made of a corrosion resistant material, like precious steel. It measures, for example, 100 mm (length in longitudinal direction of the belt)×80 mm (width in transverse direction of the belt) and is about 2 mm thick. It serves to absorb the counter forces during the actuation of the pump, as will be explained in the following. One jacket 9 of a Bowden or rope pull generally designated with the reference numeral 11 is mounted on the plate 5 by means of a clamp like mounting 7. Thereby, the axis of the jacket is positioned parallel to the transverse extension of the belt, in the drawing the (shorter) transverse extension from the top to the bottom. In its upper portion the jacket is somewhat deflected from plate 5, so that its axis extends oblique with respect to the plate plane at this point. The jacket 9 is mounted by the clamp 7 on plate 5 in such a manner that it is rotatable around its longitudinal axis by about 180°. A slight longitudinal displacement in the direction of the longitudinal axis of the jacket is limited by abutments 13 on the jacket. At the upper somewhat deflected end of jacket 9, the sheath 15 of the Bowden pull 11 is mounted when attaching the belt. This consists of a helical wire, which is provided with a PVC, for example, but which is also corrosion resistant. The sheath 15 is incompressible in its longitudinal direction. Thereby, it can transmit the pressure forces exerted thereon by its other end (not shown in FIG. 1) through the jacket 9, the upper abutments 13, the clamp 7 and the plate 5 onto the belt. It transmits the force symmetrically to the wearer of the belt due to the location of the plate in the center of the belt. From the lower opening of jacket 9, facing away from sheath 15, the rope or the wire of the Bowden pull exits.

The end of the wire 17 extends in its maximum upwardly displaced position, i.e. at a maximum pushed in position of jacket 9, about 30 mm from jacket 9. A roller shackle 21 is mounted on the lower end of the wire. A rope 25 is mounted over roller 23 of the shackle. Preferably the rope 25 consists of a softer material, for example, nylon or another similar plastic material. The rope 25 has a length which corresponds to about twice the distance between the sacrum and the feet which are pulled in by a swimmer in the breast stroke position. Preferably, it is adjustable in its length (not shown). On the two ends of the rope 23 which is guided over roller 23, devices are provided for mounting the rope on the feet of the diver. In the simplest case they may be foot loops 27. The roller shackle 21 is not necessarily required, but it has the advantage that a force is transmitted by both legs even at a different stretching of the legs, so as to pull the wire 17 in the direction of the arrow 19 from the jacket 9. However, it can also be seen that both halves of rope 25 may be individually mounted on wire 19, for example, for leg amputees, so that only one halve of rope 25 may be provided.

Diver weights are designated with the reference numeral 29 which can be mounted on belt 1 in a conventional manner. The rivets for connecting the individual parts with each other are designated with the reference numeral 31.

In FIG. 2, the pump is shown in a sectional view and in particular the mounting of the actuating devices thereon. The pump which is generally designated with the reference numeral 33 is designed as a piston pump. It has a cylindrical housing 35 wherein a piston 37 is sealingly guided. The sealing is obtained by suitable rubber rings 39. The piston 37 separates the inner space of the housing 35 into two changeable partial chambers 41 and 43. Continous bores 45 are provided in piston 37 which are closed at excess pressure in the lower partial chamber 43 with respect to the upper partial chamber 41, that is in the pressure phase of the pump, by a schematically shown valve plate 47, so that the form a valve therewith. This valve opens in the suction phase, so that air can penetrate through the reduced chamber 41 into the enlarging chamber 43. Continous bores 53 are provided in the bottom plate of the housing bottom plate 51 which also constitutes the bottom of the partial chamber 43, whereby these bores are closeable by an also schematically shown valve plate 55, so that bores 53 and the valve plate 55 together form a second valve. The opening facing away from the partial chamber 43 of the second valve leads into a socket 57 mounted on the bottom plate 51. This socket 57 is introduced into the air inlet opening of the tube like supply element which is designed as a flexible rubber hose 59. The rubber hose 59 is safely connected by suitable connecting means, like hose connectors.

The second valve 53,55 closes at excess pressure in the rubber hose 59 with respect to the changeable lower partial chamber 43, in particular in the suction phase of the pump, while it opens at the excess pressure in chamber 43 with respect to hose 59, in particular in the pressure phase. The hose 59 ends in an air outlet opening designed as a mouth piece (see FIG. 4).

The valves are so dimensioned with respect to size and the necessary forces for their opening, so that during diving in an air intake depth a normal air intake breathing is made possible without mechanical assistance.

A jacket 63 is inserted in the center of the bottom part 51 which serves as the other second jacket for the Bowden pull. The sheath 15 is mounted on jacket 63, while the rope 17 extends therethrough. The rope or the wire 17 is centrally connected on piston 37 by means of a mounting part 65 which in turn is integrally connected with piston 37.

By a pull in the direction of arrow 67 the piston 37 is pulled downwardly and thereby compresses the air in the area 43 since valve 45,47 closes.

An accumulator is mounted on piston 37, in this case a restoring rubber 69. The restoring rubber 69 runs over a deflection roller 71 with its rotational axis 73 in a direction vertical with respect to the axis of housing 35. The other end of the restoring rubber 69 is fixedly anchored on a mounting part 75 which in return is adjustably mounted on the outer wall of the housing 35. Thereby, the pretension of the restoring rubber can be adjusted.

Colored sectors are mounted on the outer free side face or both side faces of the deflection roller 71. These fulfill a warning function similar to a bright colored paint which can be mounted on housing 15 and thereby make it possible in a simple manner whether the roller 71 rotates due to the design as sectors, that means whether the pump is actuated by the diver or not.

A circular shaped swim element 77 is connected with housing 35 in such a manner that it maintains the housing with its longitudinal axis substantially vertical when the swim element and the housing are immersed in the water 79. The lifting obtained by the swimmer 77 is so calculated that at least the air entry opening 49 of the housing, preferably also the opening of the sheath 63 in chamber 43 is held above water when the lifting element 77 is charged by the weight of pump 33, hose 59 and the Bowden pull 11.

Preferably, the swimmer is inflateable as indicated by the rubber socket 81 with stopper 83. It is, for example, an air balloon type structure which has a sufficient rigidity, on the one hand, but which require only small space when the air has been released.

It is obvious that in the embodiment of FIG. 2, the pump is positioned on the upper end of the tube like supply element 59. This is advantageous, as mentioned, that the diver can move independent from the pump and that it can perform much better as a warning and locating function.

However, a second upper part of the tube like connecting piece may be mounted on the air suction opening 49, for example, by means of a socket, so that the pump can be completely immersed into the water by means of a suitable dimensioning of the lifting means 77. Depending on the stability of the vertical position of the pump the upper part of the tube like connecting piece is designed rigid or flexible, in the latter case provided with an own lifting device which maintains the air inlet opening above the water surface.

In FIG. 3 a further embodiment of the pump is shown and a part of the associated actuating devices for its actuation in accordance with the invention. The same reference numerals, indicate the same or corresponding parts as shown in FIGS. 1 and 2.

The embodiment in accordance with FIG. 3 differs from the embodiment in accordance with FIG. 2 in particular in that the sheath 63' of the Bowden pull 11 extends through the bottom 51 into the inner space of the housing 35 to the proximity of the upper cover 51' of the housing. The jacket is shaped as a thin rigid tube. This extension of the jacket makes it possible to immerse the pump deeper into the water due to suitable attachment and dimensioning of the inflatable swimmers 77. This considerably increases the stability of the pump against tilting. However, it is essential to have the outlet opening for the wire 17 outside of jacket 63' (as already mentioned in FIG. 2) and above the water surface since a complete sealing of the Bowden pull is mostly not obtainable, so that the Bowden pull is filled with water during the use of the device in accordance with the principle of the communicating pipes up to the height of the water surface.

In order to enable a movement of the piston 37' of the pump over the total length of housing 35, a bore is provided in the center of the piston for the penetration of the piston through the jacket 63' which is extended upwardly by a sealing rigid piston tube. Therefore, this tube still belongs to the lower partial chamber 43 of the pump and is therefore closed on top by valve 45',47' in such a manner that the valve plate 47' only opens the opening 45' only at a vacuum pressure in chamber 43 with respect to the atmospheric pressure.

A screen plate 87 is provided vertically with respect to the longitudinal axis within pipe 85 which permits the throughput of air flowing through valve 47', on the one hand, and permits the central mounting of the pulling rope or the Bowden pull wire 17, on the other hand. By mounting the Bowden pull wire 17 on the screen plate 87 and thereby on pipe 85, the pipe 85 acts as a piston rod pushing the piston 37' downwardly in the direction of the arrow 67 when pulling the wire 17.

A detachable flange 89 is guided around the pipe in the proximity of the upper end of pipe 85 against which a torsion spring 93 supports and is held against a lateral displacement by a flange 91 directed downwardly in a vertical position toward the pump housing. With its other end the torsion spring 93 supports on the upper housing closure 51' on which it is secured against the lateral displacement by a flat socket 95 which corresponds to its diameter. A bore for the throughput of pipe 85 is provided on the upper housing closure 51' which simultaneously serves as a pressure equalizer opening.

The metal bottom part 51 as well as the upper closure 51' is screwed together with the cylinder wall of housing 35. The socket 57 including the valve 53',55' is also screwed into the bottom part 51. Also screwed to the bottom part 51 is the socket 63'.

A spray protector 97 is provided for covering the valve opening 45' with air inlet openings 49 which prevents the penetration of water at rough seas. The arrangement of the valve 45',47' on the upper end of the pipe already makes a penetration of water rather difficult.

FIG. 4 shows the design of the air outlet opening of the tube like supply element 59. The air outlet is shaped like a mouth piece 99, as is known from air intake or compressed air devices. In addition, a breathing out valve is provided which is generally assigned with the reference numeral 101 in the proximity of the hose 59 in close proximity to the mouth piece.

In view of the fact that the breathing out valve is provided in the proximity of the mouth piece, it is admitted at its water side with about the same pressure which also prevails on the outside of the lungs. A torsion spring 103 on the valve closure prevents an opening of the valve if a slightly larger pressure prevails than the waterside pressure. For example, the torsion spring can be so adjusted that it opens the valve at a mouthpiece side excess pressure of 500 Pa (0.005 Bar). The breathing out valve has two advantages: First, it permits a breathing out through the mouth, without detaching the mouth from mouthpiece 99. Secondly, it prevents that air is pumped by the pump into an already completely filled lung, whereby a damaging excess pressure may be generated in the lung. During normal breathing in and out rhythm whereby the lung can expand during each renewed filling, only the pressure has to be overcome which prevails on the outside of the lung, since the lung is filled comparable with a limp air balloon under water. Therefore, in the lung and on the pressure side half of the pump only the water pressure prevails on the outside of the lung until reaching the fill limit of the lung.

In the following the mode of operation of the total device is described, whereby the unprimed and primed reference numerals also indicate to the primed reference numerals.

In a first condition of the total device the Bowden pull wire 17 is in the condition shown in FIG. 1, i.e., in the sheath 15 displaced as far as possible in the direction of the pump. Thereby, the roller shackle 21 is pulled close to the belt 1, it is in the proximity of the sacrum of the diver during use. The feet of the diver which are in the loops 27 are also pulled in. In this condition the piston 37 in pumps 33 of FIGS. 2 and 3 are in the uppermost position relative to the pump housing, i.e., the pump has suctioned the maximum possible air amount. The length of the Bowden wire 17 is naturally correspondingly dimensioned. The length of the Bowden pull sheath is the result from the maximum desired diving depth and the position of the pump relative to the water surface. In this first condition, the accumulators 69 or 93 are relaxed and the valves 53,55 are closed due to the excess pressure prevailing in hose 59, so that the pressure cannot escape, so that a pressure prevails on the inside of the length corresponding to the diving depth.

By stretching one or both legs, the feet move away from the sacrum of the diver and thereby the loops 27 and pull the roller shackle 21 by means of the rope 25 from the plate 5 mounted on belt 1. Thereby, the Bowden pull wire 17 which is mounted on the roller shackle is pulled out of jacket 9 and displaces relative with respect to sheath 15 of the Bowden pull. Thereby, the Bowden pull wire 17 pull down the screen plate 87 and the pipe 85 which acts as a piston rod and also the piston 37, i.e., in the pressure direction of the pump. The pump housing is usable to follow this movement since it is supported over the jacket 63 and the incompressible sheath 15 of the Bowden pull, as well as by the lower jacket 9 and the plate 5 on the belt 1 and thereby finally substantially on the sacrum of the diver. Thereby, piston 37 displaces in housing 35, whereby the air is compressed in the lower changeable partial space 43. Thereby, the excess pressure which is generated in chamber 43 closes the valve 45,47 and opens the valve 55, after reaching the pressure prevailing in hose 59. Now the air in the chamber 43 is sufficiently compressed as it corresponds to the total space with which it is in connection, namely the lung and the hose 59. The water pressure surrounding the lung prevails in the lung as far as it is still expansionable, so that the air from chamber 43 is fed to the lung from chamber 43 by the further movement of piston 47 and inflates the lung. Naturally, this operation can be supported by the breathing activity of the diver. The pump diameter and the pump stroke (for example, about 10 cm or about 30 cm) are so dimensioned that a stroke volume of 2 to 3 liter is obtained which corresponds to a strong breathing. Normally, in the first condition of the device the lung is in the breathing out position, so that it can receive the air from the pump. Should that not be the case, because the diver did not breath out while pulling in the legs, so that the lung is filled up to its absorption capability the breathing valve 101 opens during a further compression of the air which corresponds to an excess pressure with respect to the lung and the water pressure of 500 Pa (0.005 Bar) surrounding the mouth piece, whereby the breathing valve 101 is held in a closed position up to this excess pressure. Thereby, even at an erroneous operating of the device there is no danger, since excess pressure begins to become dangerous to the lung only at about 15000 Pa (0.15 Bar). When the diver actively closes the air pipe an excess pressure is generated in chamber 43 of the pump and also in hose 59 which opens the valve 101 when exceeding a value of 500 Pa.

After breathing in, the diver pulls in the feet again in a swim movement. Thereby, the diver advantageously breathes out, either with excess pressure through the mouthpiece 99 and the valve 101, or through the nose. During pulling in of the legs the pull on rope 35 and thereby on the wire 17 of the Bowden pull is released. The piston 37 of the pump is pulled upwardly by the accumulator in form of the restoring rubber 69 or the spring 93 which opens the valves 43,47 and closes the valves 53,55. The stroke between the sacrum and the feet plane is about 30 cm in direction of the body longitudinal axis during a swim stroke of a grown up person, whereby the piston stroke is adjusted thereto. During the movement of the piston 37 in an upward direction it sucks air into the chamber 43, so that the initially described initial stage is again restored and the pump is again brought into the second stage by a renewed stretching of the legs and thereby by a renewed pull on the Bowden pull 19.

The least amount of force to be generated by the diver depends on the diving depth, on the one hand, and from the cross sectional face of the piston 37, on the other hand. After opening the valve 53,55 a pressure prevails in the chamber 43 and therefore also on the piston which corresponds to the inner pressure of the lung and thereby again to the outer pressure of the lung. However, the latter is defined by the normal air pressure and the water column corresponding to the diving depth. At a diving depth of 2 m this corresponds to an additional "2 m $H_2O$", i.e., 20 000 Pa (0.1 Bar). At a diameter of the piston of 10 cm and thereby a cross sectional face of about 0.008 $m^2$ a force is generated on the piston of $$2.10^4 Pa.80.10^{-4} m^2 = 160N$$

which has to be overcome. In addition there is a certain force effort for overcoming the piston friction and the friction in the Bowden pull etc. Furthermore, the force for stressing the accumulator must be also generated. Totally, the force which has to be generated corresponds to the one generated during a leisurely bicycle ride. Due to the increasing force demand and/or increasing stroke (when reducing the diameter of the piston for reducing the required force), the action radius to the depth is also reduced. Therefore, the Bowden pull and the tube like supply element are essentially so dimensioned that a maximum diving depth of 2 to 3 m is obtained while the air intake opening has not been pulled beneath the water which would make a suctioning of air impossible. Preferably, the lifting force of the swim body 77 is so dimensioned that a deeper diving than in the length of the connection to the surface is not possible by the inherited force of the diver, so that the air suctioning opening cannot be accidentally pulled below water.

The force which has to be generated by the legs is effective over the Bowden pull on the sacrum, but which is very able to absorb this force due to the structure of the belt.

In practical tests, a pump of the trademark Metzler, article number 210-5424 has been successful, whereby a spring with a force of about 50-100$^n$ was tensioned between the piston rod and the housing and by which two styropore blocks of about 25.50.10 $cm^3$ are kept above the water surface. Thereby a hose connection of 2 m from the pressure socket was chosen. The hose and the Bowden pull were connected up to the proximity of the body which increased the stability of the device.

From the aforegoing it can be seen that the structure shown in the exemplified embodiment makes it possible that the diver can dive by the mere movement of the pulling in and pushing out of the legs which are known to each diver during swimming, which also serves to the further movement without any large apparatus effort into depth which are of interest to the intake air diver, which were heretofore not able to reach without compressed air bottles, for any given length of time which is merely limited by other physiological circumstances (tiring, undercooling).

The diving in these depths does not cause any other dangers, since no decompression times have to be considered, and one can rapidly emerge, while the air supply is unlimited. Therefore, it is in no way more dangerous than the usual air intake diving.

I claim:

1. A diving device for underwater breathing comprising:

(a) an air conduit having an inlet for receiving air from above the water and an outlet for delivering air to at least one mouth piece;

(b) a reciprocating piston air pump including a pump closure for delivering air to the air conduit inlet upon the compression stroke of said pump;

(c) means actuated by the diver including a cable connected to said piston for causing the compression stroke of said pump upon the pulling of said cable;

(d) biasing means for returning said piston for the instake stroke of said pump upon the completion of the compression stroke; and (e) a check valve in said air conduit permitting air to pass through to said air conduit outlet upon said compression stroke and closing upon said intake stroke.

2. The diving device as defined in claim 1, wherein the displacement of said piston pump is designed to correspond with a breathing volume at light to medium body stress.

3. The diving device as defined in claim 1, which further includes:

(a) a tube extending from said piston parallel to the direction of motion, the end connected to said piston being open to the volume of said pump below said piston;

(b) a longitudinally incompressible sheath fixedly extending into said pump and through the open end of said tube in said piston to near the upper closure of said pump, said cable of said actuating means being displaceably moveable in said sheath and connected to the other end of said tube;

(c) a check valve in said tube for permitting air to enter said pump volume below said piston upon the intake stroke of said pump and being closed upon the compression stroke of said pump; and (d) an opening in the upper closure of said pump through which said tube passes.

4. The diving device as defined in claim 1, which further includes an overpressure valve in said air conduit near said outlet for allowing the overpressure therein to escape.

5. The diving device as defined in claim 4, wherein said overpressure valve includes a biasing means which opens the valve at an overpressure in the air conduit of 0.2 to 3 kPa.

6. The diving device as defined in claim 4, wherein said overpressure valve includes a biasing means which opens the valve at an overpressure in the air conduit of 0.5 kPa.

* * * * *